US005799946A

United States Patent [19]

Groussman

[11] Patent Number: 5,799,946

[45] Date of Patent: Sep. 1, 1998

[54] METHOD OF PLAYING A MODIFIED BLACKJACK GAME

[76] Inventor: Raymond K. Groussman, 276-204 N. El Camino Real, Oceanside, Calif. 92054

[21] Appl. No.: 932,200

[22] Filed: Sep. 17, 1997

[51] Int. Cl.[6] ..... A63F 1/00

[52] U.S. Cl. ..... 273/292; 273/309

[58] Field of Search ..... 273/292, 274, 273/309; 463/12, 13

[56] References Cited

U.S. PATENT DOCUMENTS

| | | | |
|---|---|---|---|
| 5,174,579 | 12/1992 | Griffiths | 273/292 |
| 5,632,485 | 5/1997 | Woodland et al. | 273/292 |
| 5,660,391 | 8/1997 | Klasee | 273/292 |

*Primary Examiner*—Benjamin H. Layno

[57] ABSTRACT

A modified method of playing Blackjack wherein a player plays one hand against the dealer's one hand and the player can optionally make a modified 21 wager called "Texas 21 Wager" and/or a conventional 21 wager before the start of the deal. A winning Texas 21 wager pays double the amount paid on conventional 21 wagers. The player loses the Texas 21 wager whenever the dealer's face-up card is a three, four, five or six or when the dealer's hand beats the player's hand. An embodiment of the present invention in one version of the invention is a modified Blackjack table layout that has double wager boxes for each player. One "21" wager box is for conventional 21 wagers and an adjacent 21 wager box with indicia within showing "Texas 21 Wager Pays Double" where the player places his modified Texas 21 wager. In another version of this modified Blackjack game a conventional Blackjack table layout can be used. On the conventional layout when the player desires to make a conventional 21 wager and/or a Texas 21 wager the player places his wager or wagers in his 21 wager box with a Texas 21 wager marker disc on top of the Texas 21 wager. The conventional 21 wager and the player's and dealer's hands are played as they are played in conventional Blackjack games. The Texas 21 wager is won or lost according to the conventional rules of Blackjack except that the player always loses the Texas 21 wager when the dealer's face-up card is a three, four, five or six, whether or not his hand beats the dealer's hand. The Texas 21 wager cannot be split or a double down wager made on it.

1 Claim, 4 Drawing Sheets

METHOD OF PLAYING A MODIFIED BLACKJACK GAME

FIELD OF INVENTION

This invention relates to a modification of the method of play of Blackjack in which a player plays one hand against the dealer's one hand and more particularly to a modification in which the player plays a modified 21 wager that pays winning players double the usual amount paid to winners of conventional 21 wagers. The player may also make a conventional wager instead of the modified wager or the player may simultaneously play the modified 21 wager and the conventional 21 wager.

BACKGROUND OF THE INVENTION

The conventional casino Blackjack table is a half-circle with one curved side for the players to stand or sit and a straight side where the dealer stands or sits. Most conventional Blackjack tables have five, six or seven player positions. Each player position has a single "21" wager box.

As used in this patent application the terms "conventional Blackjack" and "the conventional manner of play of Blackjack" means the game of Blackjack as described on pages 276–282 of Scarne's Encyclopedia of Games by John Scarne, Harper & Row publishers and as described herein.

At least one standard deck of 52 playing cards is used and each card counts its face value, except Aces which have a value of one or eleven as is most beneficial to the count of the player's hand and face cards which have a value of ten.

The player's object of the game is to get a higher count (total value of cards in hand) than the dealer's hand, but not over 21.

In the conventional game of Blackjack a "21" wager is made by each player before the start of the deal. When the dealer's final hand is closer to 21, but not over, than the player's hand or the player busts the player loses that wager. When the player wins that wager the dealer pays the player an amount equal to the player's "21" wager, except when the player gets a winning blackjack hand the dealer pays the player one and one-half times the amount of the player's wager.

Those skilled in the art know that individual casinos pay larger odds and/or various bonuses in addition to the conventional payoffs.

Each player initially receives two cards. The dealer also receives two cards. One of the dealer's cards is dealt face-down and the other face-up. In some casinos, the dealer receives his two cards at the same time that each player is dealt his two cards. In other casinos, the dealer initially only receives one card which becomes the dealer's face-up card. After each player has taken additional cards, the dealer then receives his second card.

A player may draw additional cards (take "hits") in order to try and beat the count of the dealer's hand. If the player's count exceeds 21, the player "busts." The player may "stand" on any count of 21 or less. When a player busts, he loses his wager regardless of whether or not the dealer busts.

After the players have made Double Down and/or split hand bets, taken hits or have stood on their hand, the dealer "stands" or "hits", based on the table rules.

Most casino rules requires the dealer to take a hit whenever the dealer's hand is a "soft 17" or less than a 17 count. However, in other gaming establishments, the dealer stands on a "soft 17" count.

After the dealer's final hand has been established, the numerical count of the dealer's hand is compared to the count of the player's hand. If the dealer busts, the player wins. If neither the player nor the dealer has busted, the closest hand to the numerical count of 21, without going over, wins; tie hands are a "push".

There are other procedures. One well-known procedure is "Doubling Down." When the player's first two cards have a combined value of 10 or 11, or any first two cards in some casinos, the player may "Double Down" on his hand. The player turns both of his cards face-up in front of him and makes a second wager equal to the amount of his "21" wager. The dealer deals the player one additional card and the resulting three card hand establishes that player's hand.

Another well-known procedure is splitting pairs. When the player's first two cards are a pair or of equal count, the player may "split" those cards into two separate hands. His original wager is applied to one of the hands and he makes an additional wager for the other hand, equal to his original "21" wager. The player receives a new second card for each of the hands and each hand is played separately.

Another well-known procedure is "Insurance." When the dealer's face-up card is an Ace, before any cards are drawn, players may make an "Insurance" bet. Each player can wager one-half of the amount of his "21" wager as insurance against the dealer having a blackjack, i.e. a two-card 21 count (an Ace and a 10 count card) If the dealer has a two-card 21 count the player wins two-to-one on his "Insurance" bet. Also, when the dealer has a two-card 21 count, that round of the game is over and all players lose except those who also have a two-card 21 count, who "push" with the dealer. If the dealer does not have a two-card 21 count, the player loses on his insurance bet and the round of the game continues.

A disadvantage of conventional Blackjack games is that each player can make only one initial 21 wager when he plays one initial hand against the dealers single hand.

It is an object of the present invention to provide a modified method of play of Blackjack that can make the game of Blackjack more interesting and exciting to the player. There is a need for a player to be able to have a choice of playing one conventional 21 wager or playing a initial modified 21 wager that will pay much larger odds, or simultaneously playing the conventional 21 wager and one modified 21 wager. It should substantially increase the casino's profit from the game of Blackjack without increasing the size of each of the player's 21 wagers or the number of cards or hands dealt to the player or dealer.

BlackJack has its Own Language

As used in this patent application, the following words have the following meanings ascribed to them:

"Bet"—money or chips wagered on the outcome of a hand or hands.

"Blackjack"—the Americanized name of Vingt-et-un (French) and/also means 10 count card plus an Ace, totaling 21 in the player's or the dealer's initial two-card hand.

"Break" or "Bust"—having cards totaling over 21.

"Chip Tray" a flat open container on the table where the dealer's chips are held.

"Conventional Blackjack Game"—Blackjack as described In Scarne's Encyclopedia of Games pp 276–282 and/or as described in this patent application.

"Conventional Blackjack Table"—table with a half-circle side for the players and a straight side for the dealer. The table is covered with a layout with indicia printed thereon and having a single "21" wager box imprinted in each player's station.

"Conventional "21" Wager Box"—a single rectangle or other identifiable area on a Blackjack table layout identified on the accompanying drawings as item 12, where a player places his conventional "21" wager.

"Conventional 21 Wager"—An initial 21 wager made in the conventional game of Blackjack. The payoff is usually one-to-one except when the player has a two card blackjack the payoff is 3-TO-2.

"Casino"—a gaming establishment.

"Each Deal"—the dealing of one round of hands as described in Scarnes Encyclopedia of Games and/or as described herein.

"Dealer"—the person that deals the cards and conducts the game.

"Double Down"—the act of doubling the size of the bet and drawing one more card.

"Draw" or "Hit"—to take additional cards to add to the cards in the hand.

"Initial Hand"—the first hand dealt to the dealer and/or player on each round of hands. In the game of Texas Blackjack when a Texas 21 wager is made by the player and the hand is split for the conventional 21 wager the first hand dealt to the player becomes the player's initial hand that governs the winning or losing of the player's Texas 21 wager.

"Initial 21 Wager(s)"—"21" wagers made before the start of the deal.

"Layout"—a design printed onto to playing surface of the Blackjack table and/or fabric table cover that shows the 21 wager boxes, Insurance wager box, and/or other information, i.e. "Blackjack Pays 2-TO-1", "Dealer draws to a soft 17".

"Posted odds"—the payoff on a wager as shown on a table sign or as imprinted on the table layout.

"Push"—means tie, stand-off, no action. Push or tie hands are not counted as a hand being won or lost.

"Surrender"—Before taking a "hit" "surrender" is sometimes allowed. Some casinos permit the player to cancel his hand before he draws any cards by surrendering one-half of his wager.

"Texas Blackjack"—a modified Blackjack game played wherein the player can make a Texas 21 wager and/or a conventional 21 wager as shown in the embodiments of this invention.

"Texas 21 Wager Marker Disc"—A round disc with "Texas 21 Wager" imprinted on both sides of the disc.

"Texas 21 Wager Box"—A rectangle, round, oval or other identifiable area that has indicia within the box showing "Texas 21 Wager Pays Double".

"Texas Double Wager Box"—A double wager box consisting of one conventional 21 wager box and an adjacent Texas 21 wager box.

"Texas Blackjack Table Layout"—a modified Blackjack fabric table cover with a Texas double wager box, instead of a single "21" wager box, in each player's station.

"Table Sign"—a sign on the table that shows table wager limits and other information.

"Split"—to make two hands out of the original two-card pair or equal value cards.

"Station"—a designated area on a layout that has the player's wager boxes and where the dealer deals cards to the player and where winning wagers are paid.

"Wager"—money or chips wagered on the outcome of the hand to be or being played.

SUMMARY OF THE INVENTION

In the method of play of the present invention, a player plays one hand against the dealer's one hand in the usual conventional method of play when the player only makes the usual one initial conventional 21 wager.

In this modified version of playing Blackjack instead of making the conventional 21 wager the player may make a modified 21 wager called "Texas 21 Wager". Players winning this wager win 2-TO-1 on a regular win and 3-TO-1 on winning blackjacks, or whatever payoff is shown on the table sign. The player loses this wager whenever the dealer's face-up card is a three, four, five or six or when the dealer's hand beats the player's hand. The player may also simultaneously make a conventional 21 wager and the Texas 21 wager before the start of the deal.

When both bets are made simultaneously and the player splits his hand for the conventional 21 wager the first of the multiple hands dealt to the player also governs the winning or losing of the player's Texas 21 wager.

The player cannot Double Down or split the Texas 21 wager. However, the wager can be insured or surrendered except when the wager has been lost when the dealer has a three, four, five or six card face-up.

All hands dealt to the player and dealer are won, lost or tied as provided by the method of playing the conventional game of Blackjack, except for the Texas 21 wager as shown in the embodiments of this invention.

REFERENCE TO OTHER NUMBERS IN DRAWINGS

5—A modified Blackjack table layout with a Texas double wager box 9, an embodiment of this invention, in each players station.

6—Dealer's chip tray.

7—Insurance wager box.

8—Player's station.

9—Texas double wager box in each player's station.

10—Texas 21 wager box where Texas 21 wagers are placed.

11—Short line connecting the two "21" wager boxes of a Texas double wager box.

12—The section of the Texas double wager box where the conventional 21 wagers are placed.

13. A conventional Blackjack table layout.

14. A conventional single 21 wager box on a conventional Blackjack table layout.

15. A Texas 21 wager marker disc with "Texas 21 Wager" imprinted on both sides of the marker disc.

OBJECT OF THIS INVENTION

An object of this invention is to make the game of Blackjack more interesting to the players. The conventional Blackjack tables and the method of playing on those tables have remained remarkably unchanged over the years. There have been other modifications made to the basic game, however, few, if any, of the modifications have found favor with both the players and the gaming establishments.

Another object of the invention is to offer players at the table a choice of playing a conventional 21 wager that pays winners an amount equal to the wager, except when the player receives a two card blackjack he is paid 3-TO-2 or the choice of making a Texas 21 wager that pays double the amount paid to winners of the conventional 21 wagers, when he wins. The player also has the choice of playing both of those wagers simultaneously as described in the preferred embodiments of this invention.

Another object of the invention is to enable casinos to increase their profit at their Blackjack tables without increasing the maximum wager limits at the table or dealing additional hands.

PREFERRED EMBODIMENTS OF THIS INVENTION

Version 1

Figure 3:
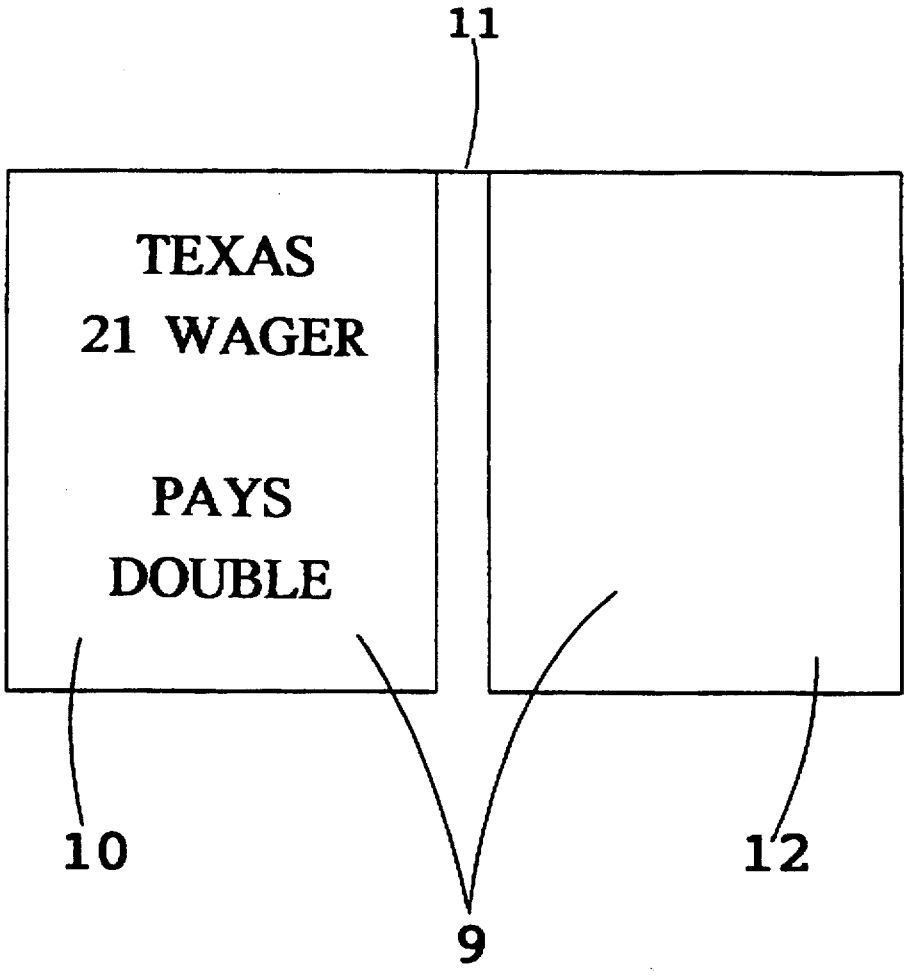
FIG. 3 shows a Texas double wager box with one 21 wager box for placing conventional 21 wagers and an adjoining 21 wager box, with indicia showing "Texas 21 Wager Pays Double", where Texas 21 wagers are placed.
Figure 4:
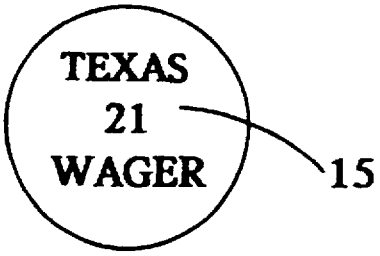
FIG. 4 shows one side of a Texas 21 wager marker disc. The opposite side of the disc is identical.

In this version of this invention the Texas Blackjack table layout 5 has TEXAS Double Wager Boxes 9 in each player's station. This double wager box is a variation of a double "21" wager box shown in FIG. 3 of U.S. Pat. No. 5,280,915, Groussman. That patent also shows that a new wager box and/or new method of playing the game of Blackjack may be integrated with a prior method and/or apparatus and still be an original method and/or apparatus.

U.S. Pat. No. 5,154,429. LeVasseur shows a Blackjack game in which a player can make three 21 wagers 22, 24, 26 before the deal and play one hand against three different consecutive dealer hands is a patentable modification of the game.

Figure 1:
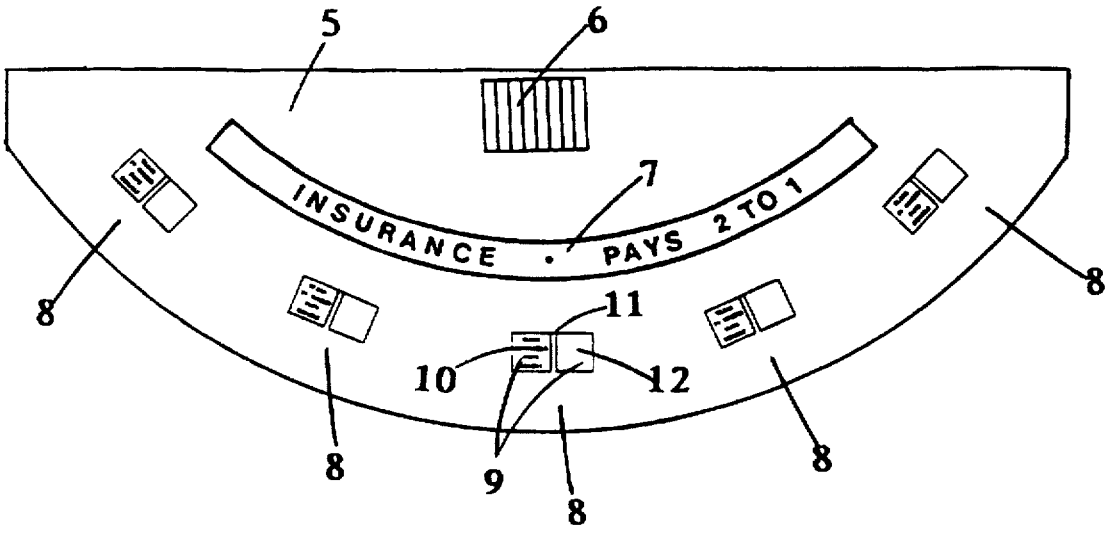
FIG. 1*a* shows a Texas Blackjack table layout, a preferred layout that is used in connection with the play of the present invention.
FIG. 1*b* shows a conventional Blackjack table layout with a single 21 wager box in each player's station.
Figure 2:
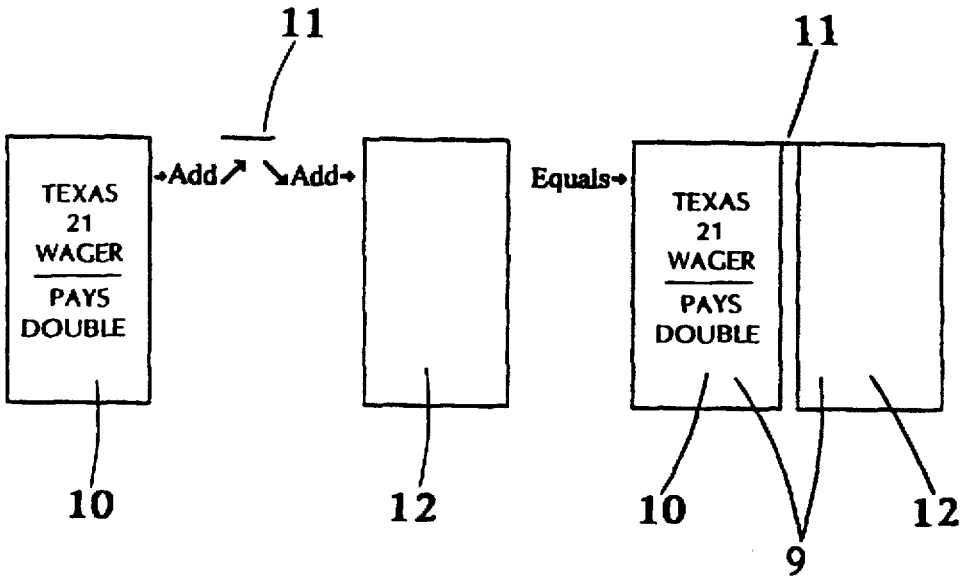
FIG. 2 is a flow chart illustrating the double wager boxes of a Texas double wager box.

FIG. 2 of the drawings for this patent application shows a flow chart of a Texas double wager box 9, a preferred embodiment of the present invention that enabled this inventor to invent this version of this modified Blackjack game. A conventional Blackjack "21" wager box 12 has been placed adjacent to another wager box 10 with indicia within the wager box 10 showing "Texas 21 Wager Pays Double" being an embodiment of this invention.

The result of integrating the wager box 10 with a conventional 21 wager box 12 has enabled this inventor to create an original Texas double wager box 9, an embodiment for this invention. Placing a Texas double wager box 9 in each player's station 8 has enabled this inventor to create a modified Blackjack layout apparatus 5 by placing two or more stations 8 onto layout 5. Optionally the wager box 12 and the Texas 21 wager box 10 can be separate or adjacent oval, circle or other shaped wager boxes.

In version one of the invention, a preferred embodiment of this invention is a modified casino Blackjack layout 5 that is used with a modified method of playing this Blackjack game. The table layout 5 has a dealer's chip tray 6 provided on the dealer's side of the table. There are two or more player stations 8 opposite the dealer's side of the table. There is also an "Insurance" wager box 7 imprinted on the layout 5. In each player's station 8 there is a Texas double wager box 9 comprised of one Texas 21 wager box 10 and an adjacent conventional 21 wager box 12. There may also be other indicia on the layout 5.

The embodiments of the present invention also comprises a method of playing a modified Blackjack game that enables each player to make one initial conventional 21 wager 12 to play as played in conventional Blackjack games and/or to make a Texas 21 wager 10 that pays double the amount paid on conventional 21 wagers 12.

In the preferred embodiment of the present invention, the player must make a conventional 21 wager 12 and/or a Texas 21 wager 10 before the start of the deal to be eligible to participate in the play of the game.

The conventional 21 wager 12 is played, won or lost as determined according to the conventional manner of play of Blackjack and the usual conventional payoff for the conventional 21 wager is an amount equal to the wager, however, if the winning hand is a two-card blackjack the payoff is usually 3-to-2. If the player has made a Texas 21 wager 10 and the player splits his hand to make an additional conventional 21 wager 12 the first hand dealt to the player's multiple hands becomes his initial hand and governs the winning or losing of the Texas 21 wager 10 in addition to the winning or losing of the split hand wager dealt to player's conventional 21 wager 12.

The player plays his conventional 21 wager 12 and his hand or hands against the dealer's hand according to the conventional manner of play of Blackjack.

The winning or losing of the conventional 21 wager 12 and the player's hand or hands are according to the conventional manner of play of Blackjack.

The Texas 21 wager 10 can be won by the player only when the dealer's face-up card is an Ace, two, seven, eight, nine, ten, Jack, Queen or King and the player's initial hand beats the dealer's hand.

When the dealer's face-up card is a three, four, five or six the player immediately loses his Texas 21 wager 10 and the dealer picks up the losing Texas 21 wager 10 as soon as the players all receive their second card and then the game continues. If the player did not also place a conventional 21 wager on that hand the dealer will also pick up the player's hand when he picks up the player's losing Texas 21 wager.

No Double Down or split wagers are permitted on the Texas 21 wager 10. When the conventional 21 wager 12 is surrendered the player may also surrender the Texas 21 wager 10 if the dealer's face-up card is not a three, four, five or six.

These embodiments enabled this inventor to invent this invention.

When the dealer's face-up card is an ace the player may make an insurance wager 7 on his 21 wager 12 and/or if the dealer's face up card is not a three, four, five or six the player may also insure the Texas 21 wager 10 by wagering an amount equal to one-half the amount of the wager or wagers insured. If the player wins the insurance wager 7 the dealer pays the player double the amount of the insurance wager 7. If the player loses the insurance wager 7 the dealer picks up the wager and the game continues.

A player may draw additional cards (take hits) in order to try to beat the count of the dealer's hand. If the player's count exceeds 21 the player "busts" and the dealer picks up the player's losing wager 10 and/or wager 12. The player may "stand" on any count of 21 or less.

When a player's hand busts he loses his conventional 21 wager 12 and/or the Texas 21 wager 10 regardless of whether or not the dealer busts.

After all of the players have made their Double Down and Split hand bets, taken hits or stand on their hand, the dealer stands or hits based on the table rules for the game. When the dealer's final hand has been established, the numerical count of the dealer's hand is compared to the numerical count of the player's hand(s). If the dealer busts, the player wins his hand or hands and wins his conventional 21 wager(s) 12 regardless of the numerical count of his hand, unless the player's hand or hands are over a count of 21. The player also wins his Texas 21 wager 10 unless the dealer's face-up card was a three, four, five or six. When the dealer's face-up card and the total of the card count in the hands have been determined, the dealer collects the losing wagers and pays all winning wagers Version 2

In this version, the method of play of Texas Blackjack is the same as in version 1 described above except that a conventional Blackjack table layout 13 is used for the game. The layout 13 has one single 21 wager box 14 in each player station; and in this version of Texas Blackjack each player at the table is furnished one or more Texas 21 wager marker discs 15 ; and when the player desires to make a conventional 21 wager he places his wager in his 21 wager box 14 and plays the game as played in conventional Blackjack games.

When the player desires to just make a Texas 21 wager he places his wager in his 21 wager box 14 with a Texas 21 marker disc 15 on top of the wager. When the player desires to play both wagers he places both 21 wagers in his 21 wager box 14 with a Texas 21 wager marker disc 15 on top of the wager intended to be the Texas 21 wager. The game continues and is played as shown above in version 1.

While two versions of this wagering game have been described, it will be appreciated that other variations and modifications are possible.

While the invention has been illustrated with respect to specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

Based on the information provided in the previous pages, I claim:

1. A method of playing a modified version of Blackjack using at least one conventional deck of 52 playing cards, and a table layout having a dealer station located on one side of the table, and a plurality of player stations along the periphery of the side opposite the side of the dealer station, each player station having a first wager box to place conventional "21" wagers and an adjacent second wager box with indicia printed within showing modified 21 wager where the player places a modified 21 wager, the method of playing this modified Blackjack game comprising the steps of:

(a) assigning each player to a player station and requiring each player to place a conventional 21 wager and/or a modified 21 wager in their appropriate "21" wager box in order to receive a hand of cards and participate in the game;

(b) the player allowing to simultaneously play both wagers, the method comprising the steps of:

(c) allowing each player to optionally place a conventional 21 wager in his conventional 21 wager box and/or place a modified 21 wager in the modified 21 wager box with indicia within the box;

(d) the dealer dealing one initial hand of two cards in accordance with the conventional manner of play of Blackjack to each playing station having a wager in at least one of the two 21 wager boxes;

(e) the dealer dealing an initial dealer's hand of two cards, one of the cards being face-up;

(f) the dealer looking at his face-up card and if the dealer's face-up card is a three, four, five or six the player losing the modified 21 wager and the dealer collecting the modified 21 wager, and if the player does not also have a "21" wager in his conventional 21 wager box the dealer also picking up that player's initial hand;

(g) each remaining player either electing to stay and have no cards dealt to their initial hand or electing not to stay and having the dealer deal additional cards to their hand in accordance with the conventional play of Blackjack;

(h) the player to make an additional wager in the form of a double down bet on the conventional 21 wager in accordance to the conventional manner of play of Blackjack;

(i) the player allowing to make a split wager for the conventional 21 wager in accordance to the conventional manner of play of Blackjack;

(j) when the initial hand is split, assigning the first hand dealt to the player as the player's initial hand governing the player's winning or losing of the modified 21 wager;

(k) when the dealer's face-up card is an ace, allowing the player to make an insurance wager on the conventional 21 wager and/or the modified 21 wager in accordance with the conventional manner of play of Blackjack;

(l) the dealer either staying and having no cards dealt to the initial dealer's hand, or not staying and dealing additional cards to the dealer's hand in accordance to predetermined Blackjack rules set forth by the casino;

(m) the dealer comparing his hand to the player's hand(s) in accordance to the conventional manner of play of Blackjack;

(n) if the player placed a wager in the conventional 21 wager box, and if the player's hand beats the dealer's hand, the dealer paying the player's conventional 21 winning wager(s) 1-TO-1 on the wager for a regular win and 3-TO-2 if the player's initial hand is a natural;

(o) if the player placed a wager in the modified 21 wager box, and if when the dealer's face-up card is an Ace, two, seven, eight, nine, ten, Jack, Queen or King, and if the player's hand beats the dealer's hand the dealer paying the player's modified 21 wager 2-TO-1 on the wager for a regular win and 3-TO-1 if the player's initial hand is a natural blackjack the player losing the modified 21 wager if the dealer's face-up card is a three, four, five or six, or if the dealer's hand beats the player's hand;

(p) if the dealer's hand beats the player's hand, the dealer collecting the players losing wager or wagers.

* * * * *